US009499884B2

(12) United States Patent
Jansson et al.

(10) Patent No.: US 9,499,884 B2
(45) Date of Patent: Nov. 22, 2016

(54) CERMET

(75) Inventors: Bo Jansson, Ramsberg (SE); Jenni Zackrisson, Fagersta (SE); Tomas Persson, Avesta (SE)

(73) Assignee: SECO TOOLS AB, Fagersta (SE)

( * ) Notice: Subject to any disclaimer, the term of this patent is extended or adjusted under 35 U.S.C. 154(b) by 1097 days.

(21) Appl. No.: 13/140,682

(22) PCT Filed: Dec. 17, 2009

(86) PCT No.: PCT/SE2009/051448

§ 371 (c)(1),
(2), (4) Date: Jun. 17, 2011

(87) PCT Pub. No.: WO2010/071586

PCT Pub. Date: Jun. 24, 2010

(65) Prior Publication Data

US 2011/0262296 A1 Oct. 27, 2011

(30) Foreign Application Priority Data

Dec. 18, 2008 (SE) ..... 0802600

(51) Int. Cl.

| | |
|---|---|
| ***C22C 32/00*** | (2006.01) |
| ***C22C 1/10*** | (2006.01) |
| ***C22C 14/00*** | (2006.01) |
| ***C22C 29/04*** | (2006.01) |

(52) U.S. Cl.
CPC ..... *C22C 1/1084* (2013.01); *C22C 14/00* (2013.01); *C22C 29/04* (2013.01)

(58) Field of Classification Search
CPC ..... C22C 1/1084; C22C 29/04; C22C 14/00
USPC ..... 420/580
See application file for complete search history.

(56) References Cited

U.S. PATENT DOCUMENTS

| | | | | |
|---|---|---|---|---|
| 5,314,657 | A * | 5/1994 | Ostlund | 419/15 |
| 6,325,838 | B1 | 12/2001 | Weinl et al. | |
| 6,340,445 | B1 | 1/2002 | Piirhonen et al. | |
| 6,344,170 | B1 | 2/2002 | Rolander et al. | |
| 6,344,445 | B1 | 2/2002 | Boursnell et al. | |
| 7,157,044 | B2 | 1/2007 | Rolander et al. | |
| 7,332,122 | B2 | 2/2008 | Weinl et al. | |

OTHER PUBLICATIONS

Houan Zhang, et al., "Properties of titanium carbonitride matrix cermets" International Journal of Refractory Metals & Hard Materials 24 (2006) 236-239.*

Ulf Rolander et al., "Effect of Ta on structure and mechanical properties of (Ti,Ta,W)(C,N)—Co cermets" International Journal of Refractory Metals and Hard Materials 19 (2001) 325-328.*

International Search Report, dated Apr. 16, 2010, from corresponding PCT application.

* cited by examiner

*Primary Examiner* — Jesse Roe
*Assistant Examiner* — Christopher Kessler
(74) *Attorney, Agent, or Firm* — Young & Thompson

(57) ABSTRACT

A titanium based carbonitride alloy containing Ti, Nb, Ta, W, C, N and Co, contains:

Figure 1:
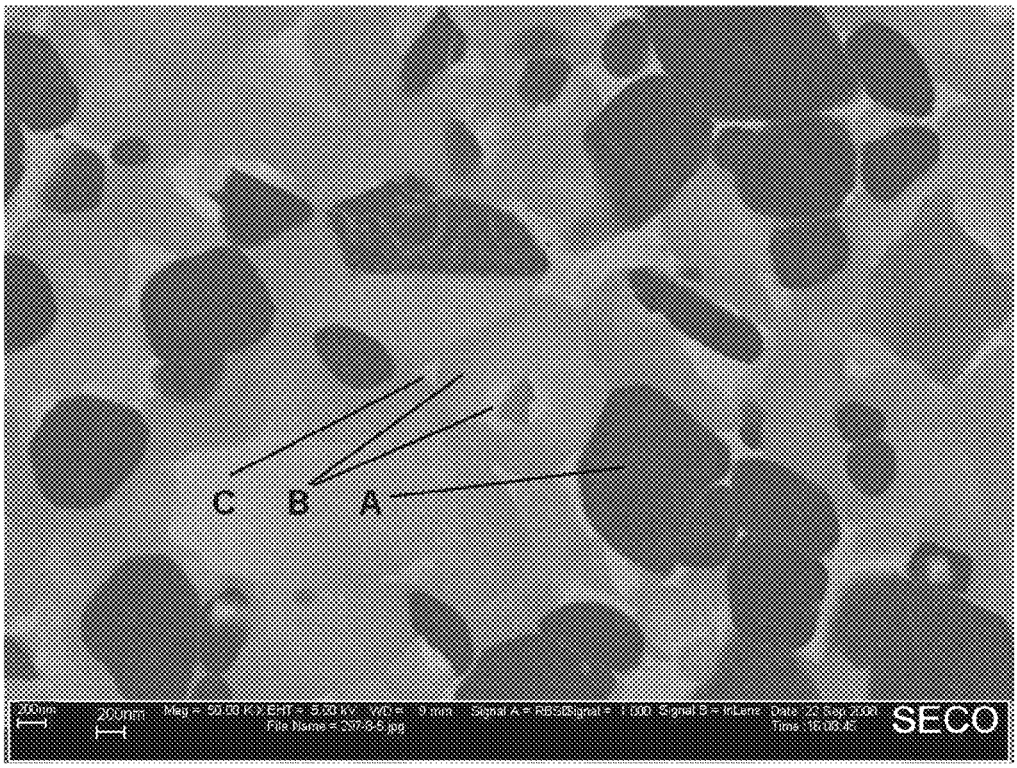

Co 7 to 21 wt %
W 14 to 20 wt %
Ta 5 to 11 wt %
Nb 2 to 7 wt % and,
Ti 33 to 50 wt % whereby the overall N/C weight ratio is 0.6 to 0.75, the Ta/Nb weight ratio 1.8 to 2.1, the relative saturation magnetization 0.60 to 0.90 and the magnetic coercivity Hc=(18.2−0.2*Co wt %) +/− E kA/m, where E is 2.0. A method of making the alloy is also described.

9 Claims, 1 Drawing Sheet

CERMET

BACKGROUND OF THE INVENTION

1. Field of the Invention

The present invention relates to a sintered carbonitride alloy with Ti as main component and a cobalt binder phase, which has improved properties particularly when used as tool material for steel and cast iron cutting. More particularly, the present invention relates to a carbonitride-based alloy of specific composition and controlled relative saturation magnetization and coercivity for optimal combination of abrasive wear resistance, toughness and resistance to plastic deformation.

2. Description of the Related Art

Titanium-based carbonitride alloys, so called cermets, are widely used for metal cutting purposes. Compared to WC—Co based materials, cermets have excellent chemical stability when in contact with hot steel, even if it is uncoated, but have substantially lower toughness. This makes them most suited for finishing operations, which generally are characterized by limited mechanical loads on the cutting edge and a high surface finish requirement on the finished component.

Cermets comprise carbonitride hard constituents embedded in a metallic binder phase generally of Co and/or Ni. The hard constituent grains generally have a complex structure with a core, most often surrounded by one or more rims of other composition. In addition to Ti, group VIa elements, normally both Mo and W, are added to facilitate wetting between binder and hard constituents and to strengthen the binder phase by means of solution hardening. One or more of group IVa and/or Va elements, e.g. Zr, Hf, V, Nb and Ta, are also added in all commercial alloys available today. Cermets are produced using powder metallurgical methods. Powders forming binder phase and powders forming hard constituents are mixed, pressed and sintered.

During recent years many attempts have been made to control the main properties of cermets in cutting tool applications, namely toughness, wear resistance and plastic deformation resistance. Much work has been done especially regarding the chemistry of the binder phase U.S. Pat. No. 6,344,170, U.S. Pat. No. 6,344,445 and U.S. Pat. No. 6,325,838 relate to a sintered body of a carbonitride alloy with titanium as main component with improved properties when used as cutting tool material. This has been achieved by combining a carbonitride based hard phase of specific chemical composition with an extremely solution hardened Co binder phase. By optimizing composition and sintering process in the Ti—Ta—W—C—N—Co system improved toughness and resistance to plastic deformation are accomplished. The two parameters that are used to optimize toughness and resistance to plastic deformation are the Ta- and Co-contents. The use of pure Co-based binder is a major advantage over mixed Co—Ni-based binders with respect to the toughness behavior due to the differences in solution hardening between Co and Ni.

U.S. Pat. No. 7,332,122, and U.S. Pat. No. 7,157,044 are similar. They relate to a titanium based carbonitride alloy containing Ti, Nb, W, C, N and Co. By replacing Ta in U.S. Pat. No. 6,344,170 by Nb and carefully controlling the amount of undissolved Ti(C,N) cores a further optimization of technological properties has been achieved. More particularly, said patents relate to a carbonitride-based hard phase of specific composition, for which the amount of undissolved Ti(C,N) cores is optimized for maximal abrasive wear resistance, while the Co and Nb contents are simultaneously optimized to give the desired toughness and resistance to plastic deformation.

SUMMARY OF THE INVENTION

It is an object of the present invention to design and produce a cermet material with specific composition and controlled relative saturation magnetization and coercivity for optimal combination of abrasive wear resistance, toughness and resistance to plastic deformation.

This has been achieved by working with the alloy system Ti—Ta—Nb—W—C—N—Co. A set of limitations has been found rendering optimum combination of abrasive wear resistance, toughness and resistance to plastic deformation for the intended application areas.

BRIEF DESCRIPTION OF THE DRAWING FIGURES

Figure 2:
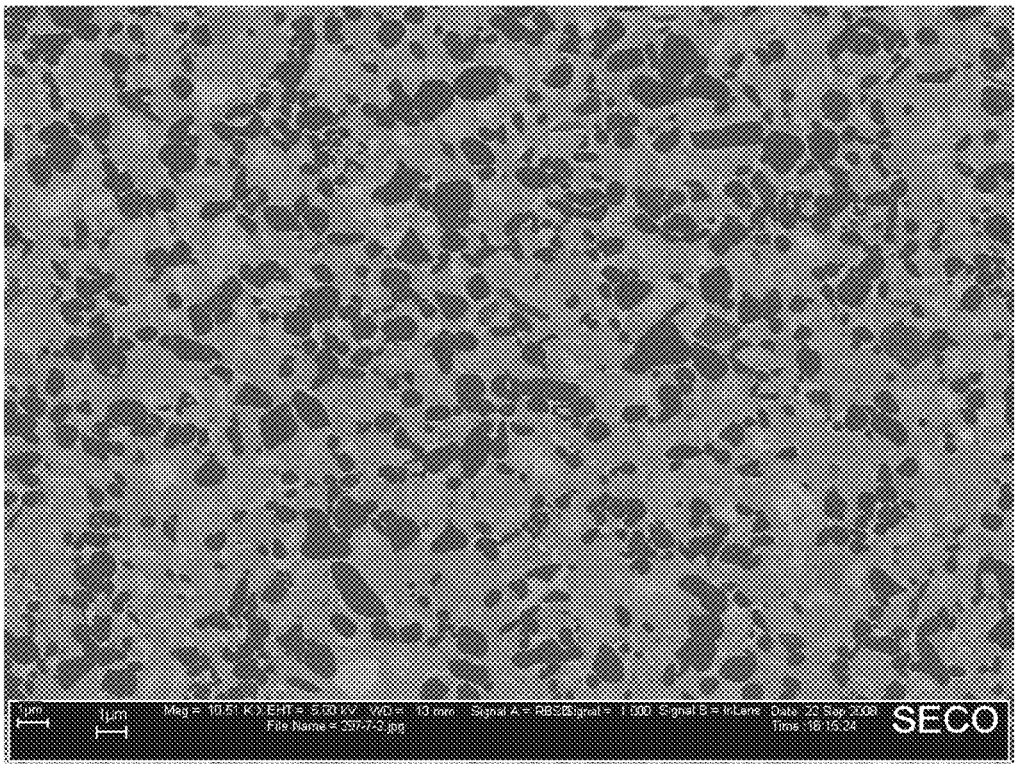

FIG. 1 shows the microstructure in detail and FIG. 2 shows the microstructure in a lower magnification of an alloy according to the invention as observed in back scattering mode in a scanning electron microscope in which A depicts undissolved Ti(C,N)-cores B depicts a complex carbonitride phase sometimes surrounding the A-cores and C depicts the Co binder phase.

DETAILED DESCRIPTION OF THE INVENTION

According to the present invention it has unexpectedly been found that optimum combination of abrasive wear resistance, toughness, resistance to plastic deformation and work piece surface finish for the intended application area has been achieved by optimizing the amount of carbo-nitride formers dissolved in the Co based binder, the ratio between Ta and Nb and the hard constituent grain size. The content of dissolved carbo-nitride formers in the binder phase may be expressed by the S-value, the magnetic saturation of the sample divided by the magnetic saturation of the same amount of pure Co as in the sample. The S-value depends on the content of dissolved metals in the binder phase and increases with decreasing amount of solutes. The sintered grain size of the hard constituents may be expressed by the magnetic coercivity.

The Co content must be chosen to give the desired properties for the envisioned application area. This is best achieved by a Co content of 7 to 21 wt %. In a first embodiment the Co-content is 8 to 15 wt % and, particularly, for fine machining applications the Co content must be 8 to 10 wt % and for applications requiring balanced resistance to plastic deformation and toughness 12 to 15 wt %. In a second embodiment requiring higher toughness the preferred Co content is 15 to 20 wt %.

The W content must be 14 to 22 wt %, preferably 16 to 19 wt %.

The Ta content must be 5 to 11 wt %, preferably 6 to 9 wt %.

The Nb content must be 2 to 7 wt %, preferably 3 to 5 wt %.

The Ti content must be 33 to 50 wt %, preferably 37 to 47 wt %.

The ratio between added Ta wt % and Nb wt % must be 1.8 to 2.1.

The overall N/C weight ratio in the sintered alloy must be in the range 0.6 to 0.75.

The C content must be adjusted such that the relative saturation magnetization is within 0.60 to 0.90, preferably 0.65 to 0.80.

The average grain size expressed by the magnetic coercivity depends on the amount of Co added and must be Hc=(18.2−0.2*Co w %) +/− E kA/m, where E is 2.0, preferably 1.5, and most preferably 1.0.

For certain machining operations requiring even higher wear resistance it is advantageous to coat the body of the present invention with a thin wear resistant coating using PVD, CVD, MTCVD or similar techniques.

In another aspect of the invention, there is provided a method of manufacturing a sintered titanium-based carbonitride alloy. Hard constituent powders of $TiC_xN_{1-x}$, having x in the range 0.45-0.55 and an FSSS grain size of 1 to 2 μm, TaC, NbC and WC are mixed with powder of Co to a composition within the limits given above and pressed into bodies of desired shape. Sintering is performed in a $N_2$—Ar atmosphere, having a total pressure of 10-40 mbar and a partial pressure of $N_2$ of 0.5 to 4 mbar, at a temperature in the range 1370-1500° C. for 0.5-1 h. It is within the purview of the skilled artisan to determine by experiments the conditions necessary to obtain the desired microstructure according to this specification.

Example 1

Three powder mixtures of nominal composition (wt %) Ti 46.4, Ta 8.2, Nb 4.2, W 17.1, Co 9.0, N 6.1 and a N/C ratio of 0.69 (Alloy A, invention), 0.74 (Alloy B, reference) and 0.64 (Alloy C, reference) were prepared by wet milling of $TiC_{0.50}N_{0.50}$ with a grain size FSSS of 1.25 μm
TaC, grain size 2.1 μm
NbC, grain size 2.0 μm
WC grain size 2.5 μm
Co grain size 0.80 μm
Pressing aid, PEG.

The powders were spray dried and pressed into SNUN120408 inserts. The inserts were dewaxed in $H_2$ and subsequently sintered in a $N_2$—Ar atmosphere, total pressure of 10 mbar and a partial pressure of $N_2$ of 1 mbar, for 1.0 h at 1480° C. which was followed by grinding and conventional edge treatment. Polished cross sections of inserts were prepared by standard metallographic techniques and characterized using scanning electron microscopy. FIG. 1 and FIG. 2 show a scanning electron micrographs of such a cross section, taken in back scattering mode. The porosity was determined according to ISO 4505 standard. Magnetic properties were determined by standard methods.

| | Relative magnetic saturation | Coercivity kA/m | Micro-porosity | Macro-porosity ** |
|---|---|---|---|---|
| Alloy A | 0.70 | 17.5 | A02-B00-000 | 0 |
| Alloy B | 0.43 | 15.0 | A06-B02-000 | 0 |
| Alloy C | 0.95 | 19.0 | A02-B02-000 | 4 |

** number of pores >25 μm per $cm^2$

The porosity levels of Alloy B and Alloy C, which are outside the preferred relative magnetic saturation range, are detrimental for the toughness.

Example 2

Six powder mixtures were prepared by wet milling of raw materials according to Example 1. For Alloy H and Alloy I a coarser $TiC_{0.50}N_{0.50}$ with a grain size of 3.5 μm was utilized. The nominal composition (wt %) is shown in the following table

| | Co | Ti | Ta | Nb | W | N | C |
|---|---|---|---|---|---|---|---|
| Alloy D | 13.5 | 43.4 | 7.7 | 4.0 | rest | 5.8 | 8.0 |
| Alloy E | 13.5 | 43.6 | 7.7 | 4.0 | rest | 5.8 | 8.6 |
| Alloy F | 18.0 | 40.8 | 7.2 | 3.7 | rest | 5.4 | 8.0 |
| Alloy G | 18.0 | 41.0 | 7.2 | 3.7 | rest | 5.4 | 8.5 |
| Alloy H | 20.0 | 39.0 | 7.0 | 3.6 | rest | 5.2 | 7.3 |
| Alloy I | 20.0 | 39.5 | 7.0 | 3.6 | rest | 5.2 | 7.8 |

Sintered inserts were prepared and analyzed according to Example 1. The results are found below:

| | Relative magnetic saturation | Coercivity kA/m | Micro-porosity | Macro-porosity ** | HV10 |
|---|---|---|---|---|---|
| Alloy D | 0.45 | 16.0 | A02-B06-C00 | 6 | 1640 |
| Alloy E | 0.75 | 16.1 | A00-B02-C00 | 0 | 1640 |
| Alloy F | 0.76 | 14.7 | A00-B00-C00 | 2 | 1530 |
| Alloy G | 0.94 | 14.7 | A06-B04-C00 | 2 | 1510 |
| Alloy H | 0.52 | 12.7 | A00-B04-C00 | 10 | 1470 |
| Alloy I | 0.69 | 13.2 | A01-B01-C00* | 0 | 1470 |

*A01 indicates porosity level in between A00 and A02
*B01 indicates porosity level in between B00 and B02
** number of pores >25 μm per $cm^2$ The porosity levels of alloys outside the preferred relative magnetic saturation range are higher and, thus, detrimental for the toughness.

Example 3

Inserts of type DCMT 11T304 of alloys D and E according to example 2 were prepared. The magnetic properties of alloy E is within the present invention. However, the saturation magnetization of alloy D is outside. The inserts were used for turning of steel SS1672 at vc=200 m/min, f=0.10 mm and ap=0.25 mm. The surface roughness of the work piece, Ra, was monitored as a function of cutting time. At shorter times, <5 min the Ra value was similar for the two alloys, 1.2 μm. After 1 h of turning the Ra value for alloy D was 3.3 μm and for alloy E 1.8 μm. The considerably better surface finish of the work piece for alloy E is due to a better resistance to wear.

Example 4

Cutting tests utilizing inserts of type DCMT 11T304 of alloys G (outside invention) and F (according to invention) in a high toughness demanding work piece were done with following cutting data:

Work piece material: DIN42Cr41
Cutting speed=220 m/min,
Feed=0.2 mm/r,
Depth of cut=0.4 mm and with coolant.
Result: Life time in number of passes, average of six edges.
Alloy G: 18
Alloy F: 28

Example 5

Plastic deformation resistance for the two alloys D (outside invention) and E (according to invention) was investigated in a turning test.

Work piece material: SS2541
depth of cut=1 mm, feed=0.3 mm/r, cutting time=2.0 min
The resistance to plastic deformation was determined as the maximum cutting speed at which no plastic deformation of the edge was detected.
Result: maximum cutting speed, average of two edges.
Alloy D: 240 m/min
Alloy E: 310 m/min
From the examples above it is clear that inserts produced according to the invention have both substantially improved toughness and deformation resistance.

The invention claimed is:

1. A titanium based carbonitride alloy, comprising:
33-55 wt % Ti,
2 to 7 wt % Nb,
5 to 11 wt % Ta,
14-20 wt % W,
C,
N and
15 to 20 wt % Co, and
the titanium based carbonitride alloy comprises undissolved Ti(C,N) cores, a complex carbonitride phase sometimes surrounding the undissolved Ti(C,N) cores, and a Co binder phase containing carbo-nitride formers,
wherein
a relative saturation magnetization is 0.60 to 0.90 and represents an amount of metals including the carbonitride formers in the Co binder phase,
an overall N/C weight ratio is 0.6 to 0.75,
a Ta/Nb weight ratio is 1.8 to 2.1,
a magnetic coercivity Hc=(18.2−0.2*Co wt %)+/−E kA/m, where E is 2.0 and represents a sintered grain size of hard constituents.

2. The titanium based carbonitride alloy according to claim 1, wherein
W 16 to 18 wt %,
Ta 6 to 9 wt %,
Nb 3 to 5 wt %, and
Ti 37 to 47 wt %.

3. The titanium based carbonitride alloy according to claim 1, wherein the alloy is coated with a thin wear resistant coating using PVD, CVD, MTCVD or similar techniques.

4. The titanium based carbonitride alloy according to claim 1, wherein the relative saturation magnetization is 0.65 to 0.80.

5. The titanium based carbonitride alloy according to claim 1, wherein the E is 1.5.

6. The titanium based carbonitride alloy according to claim 1, wherein the E is 1.0.

7. A titanium based carbonitride alloy, comprising:
Co 15 to 21 wt %,
W 14 to 20 wt %,
Ta 5 to 11 wt %,
Nb 2 to 7 wt %, and
Ti 33 to 50 wt %, and
the titanium based carbonitride alloy comprises undissolved Ti(C,N) cores, a complex carbonitride phase sometimes surrounding the undissolved Ti(C,N) cores, and a Co binder phase containing carbo-nitride formers,
wherein a relative saturation magnetization is 0.65 to 0.80 and represents an amount of metals including the carbo-nitride formers in the Co binder phase,
an overall N/C weight ratio is 0.6 to 0.75,
a Ta/Nb weight ratio is 1.8 to 2.1, and
a magnetic coercivity Hc=(18.2−0.2*Co wt %)+/−E kA/m, where E is 1.0 and represents a sintered grain size of hard constituents.

8. The titanium based carbonitride alloy according to claim 7, wherein
W 16 to 18 wt %,
Ta 6 to 9 wt %,
Nb 3 to 5 wt %, and
Ti 37 to 47 wt %.

9. The titanium based carbonitride alloy according to claim 7, wherein
Co 15 to 20 wt %.

* * * * *